US007494431B2

(12) United States Patent
Wang

(10) Patent No.: US 7,494,431 B2
(45) Date of Patent: Feb. 24, 2009

(54) 3-IN-1 DIVOT TOOL

(76) Inventor: Austin Wang, 3F-1, No. 215, Cheng-Teh Road, Sec. 2, Taipei (TW)

( * ) Notice: Subject to any disclaimer, the term of this patent is extended or adjusted under 35 U.S.C. 154(b) by 157 days.

(21) Appl. No.: 11/800,258

(22) Filed: May 7, 2007

(65) Prior Publication Data

US 2008/0280701 A1 Nov. 13, 2008

(51) Int. Cl.
*A63B 57/00* (2006.01)

(52) U.S. Cl. ..... 473/408

(58) Field of Classification Search ..... 473/408, 473/406, 286; 7/160; 401/99, 109, 110, 401/115

See application file for complete search history.

(56) References Cited

U.S. PATENT DOCUMENTS 2,896,576 A * 7/1959 Baer ..... 7/160
3,415,518 A * 12/1968 Root ..... 473/406
3,866,749 A * 2/1975 Stainer ..... 473/408
4,151,937 A * 5/1979 Jarosh et al. ..... 473/408
4,549,827 A * 10/1985 Mack ..... 401/109
4,653,949 A * 3/1987 Larizza ..... 401/109
6,030,298 A * 2/2000 Tate ..... 473/408
6,050,905 A * 4/2000 Tate ..... 473/408
6,413,173 B1 * 7/2002 Muller et al. ..... 473/408
D489,111 S * 4/2004 Perez et al. ..... D21/795
6,733,402 B2 * 5/2004 Christensen ..... 473/408
6,874,188 B2 * 4/2005 Johnson et al. ..... 7/160

FOREIGN PATENT DOCUMENTS

JP 09047533 A * 2/1997
JP 2007290333 A * 11/2007

* cited by examiner

*Primary Examiner*—Steven Wong

(57) ABSTRACT

A multi-purpose divot tool includes: a divot member having a pair of legs bifurcated from the divot member for repairing a golfing surface; a pen member rotatably mounted on the divot member and operatively protruding a ball pen or pencil outwardly for writing scores; and a marker magnetically attracted on the divot member and removably provided for marking purpose on a green.

12 Claims, 6 Drawing Sheets

Fig. 5
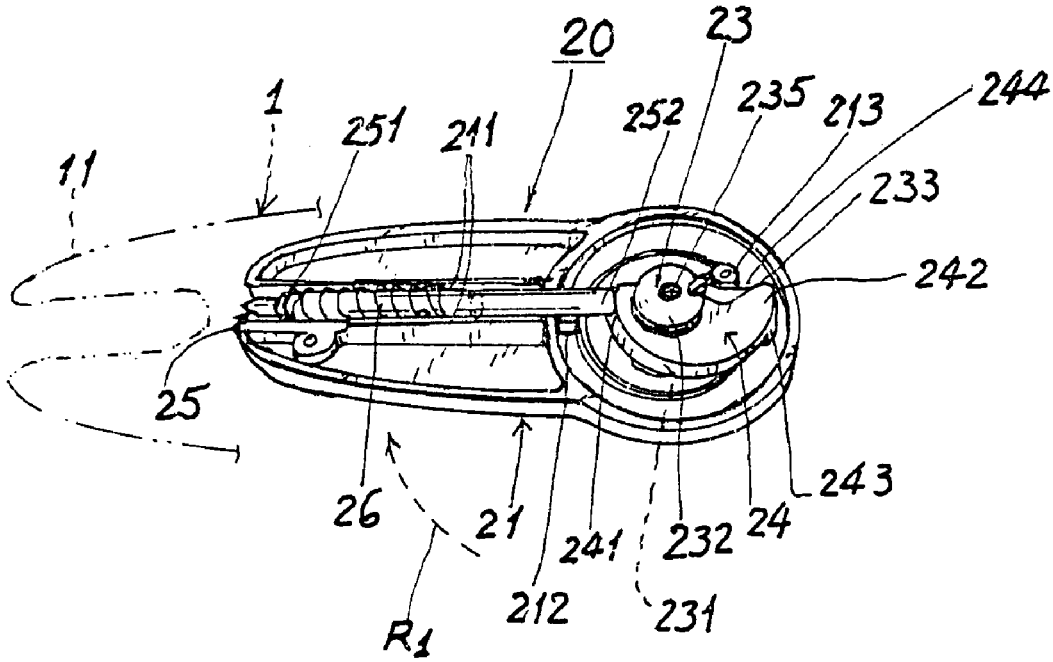
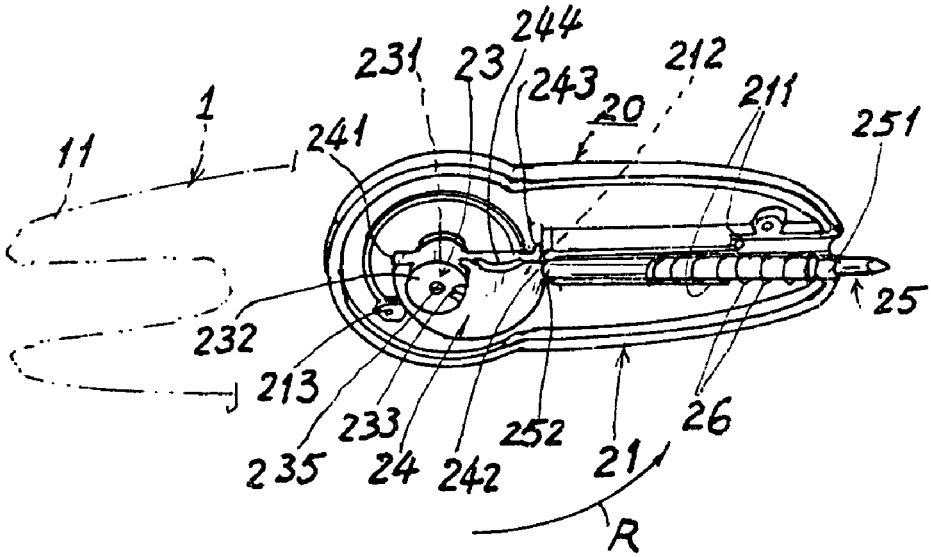
Fig. 6

Fig. 7
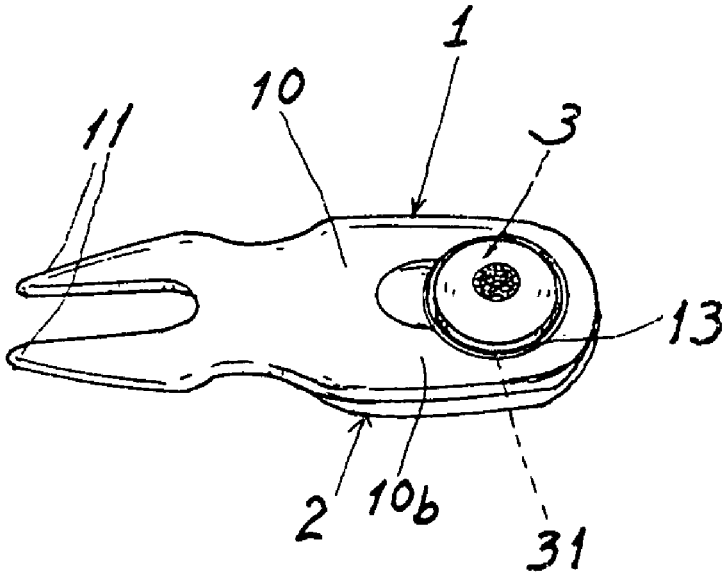
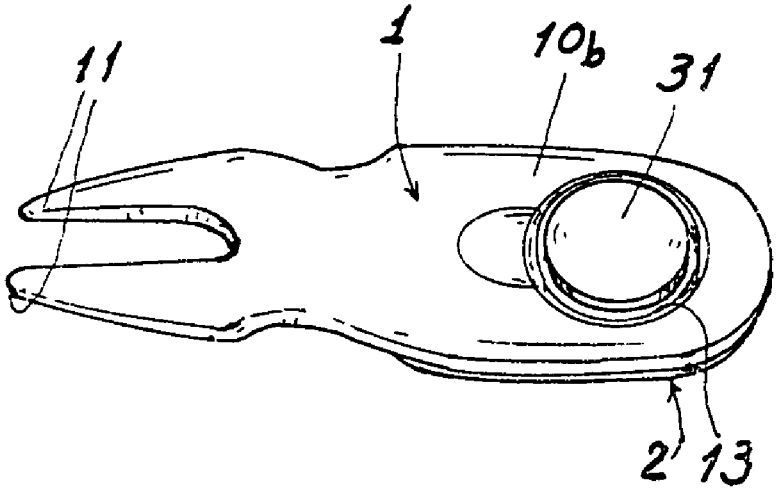
Fig. 8

3-IN-1 DIVOT TOOL

BACKGROUND OF THE INVENTION

U.S. Pat. No. 6,030,298 disclosed a divot tool with ball marker and brush. However, such a prior art has the following drawbacks:

1. When it is intended to use the pen (56 or 60) for writing purpose, the cover (16) should be first removed, and then the pen is detached from its holder (18), causing inconvenience for the golfer or user.
2. The leg body (14), the pen holder (18) and the cover (16) are detachable. Once detached, anyone of the parts or elements of the divot tool may be easily missing or lost.
3. Either pen (56 or 60), when withdrawn from the holder (18), is too short to be comfortably grasped by the golfer or user for writing or marking.

The present inventor has found the drawbacks of the prior art and invented the present 3-in-1 divot tool.

SUMMARY OF THE INVENTION

The object of the present invention is to provide a multi-purpose divot tool including: a divot member having a pair of legs bifurcated from the divot member for repairing a golfing surface; a pen member rotatably mounted on the divot member and operatively protruding a ball pen or pencil outwardly for writing scores; and a marker magnetically attracted on the divot member and removably provided for marking purpose on a green.

BRIEF DESCRIPTION OF THE DRAWINGS

FIG. 5 is a cut-away illustration showing the pen member having the pen retracted.

FIG. 6 shows the pen extended from FIG. 5 ready for writing.

FIG. 7 shows the marker attracted on the divot tool of the present invention.

FIG. 8 shows the magnet fixed on the divot member when the marker is removed.

DETAILED DESCRIPTION

Figure 11:
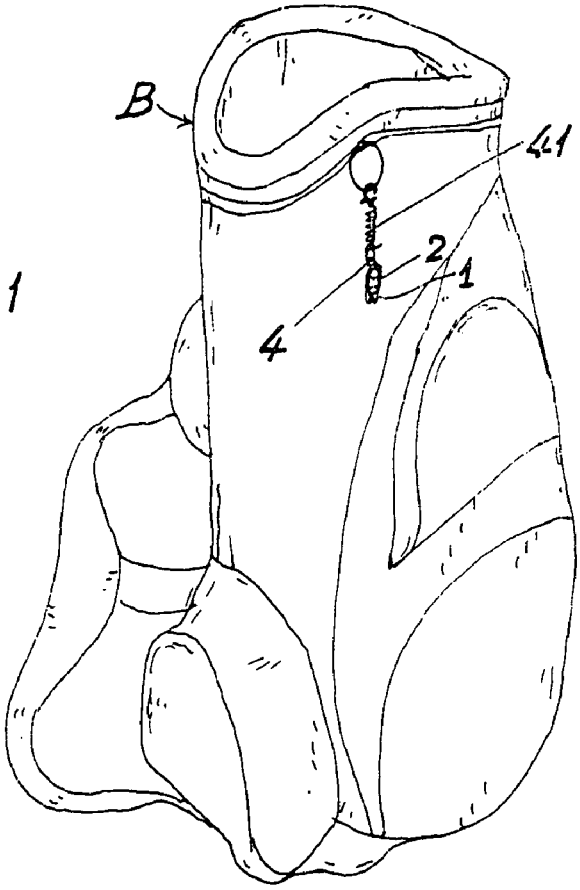
FIG. 11 shows the present invention hung on a golf bag.

As shown in the drawing figures, the multi-purpose divot tool (or 3-in-1 divot tool) of the present invention comprises: a divot member 1; a pen member 2 rotatably mounted on the divot member 1; a marker 3 magnetically attracted on the divot member 1; and a hanger 4 secured to the divot member 1 or the pen member 2 to be fastened to a golf bag B (as shown in FIG. 11).

Figure 2:
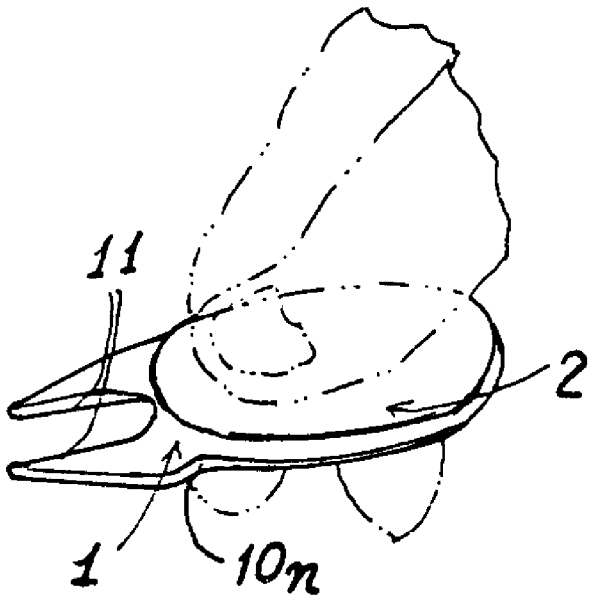
FIG. 2 shows the divot tool operated by a golfer's hand for repairing use.
Figure 12:
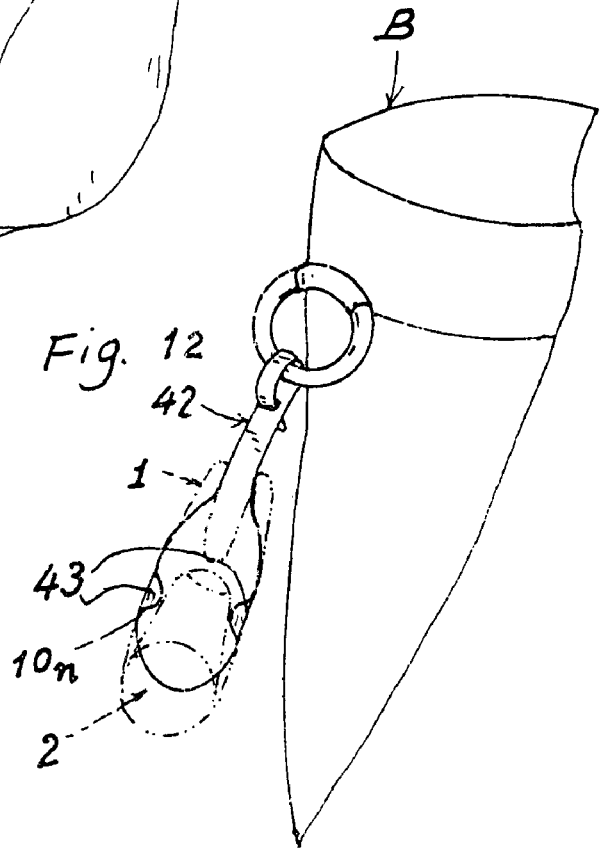
FIG. 12 shows a divot holder for clipping the present invention.

The divot member 1 has a neck portion 10*n* recessed therein adapted to be firmly grasped by a golfer's finger as shown in FIG. 2; or adapted to be clipped by a pair of clips 43 formed on a divot holder 42 fastened to the golf bag B as shown in FIG. 12.

The divot member 1 has a pair of legs 11 bifurcated from a main body 10 of the divot member 1 for repairing a golfing surface (not shown); and the main body 10 of the divot member 1 having a first surface portion 10*a* thereof provided for rotatably mounting the pen member 2 thereon, and having a second surface portion 10*b* (opposite to the first surface portion 10*a*) of the main body 10 for magnetically attracting the marker 3 thereon.

The pen member 2 includes: a housing 20 formed by combining a base 21 and a cover 22, a shaft 23 secured to the main body 10 of the divot member 1 for rotatably coupling the housing 20 on the main body 10 of the divot member 1, a cam 24 integrally formed on the shaft 23, and a pen 25 resiliently held in the housing 20 and normally restored and retracted in the housing 20 by a tension spring 26 retained in the housing 20, with the pen 25 operatively thrusted by a cam periphery of the cam 24 to be protruded outwardly from the housing 20 for writing, such as writing golfing scores.

Figure 9:
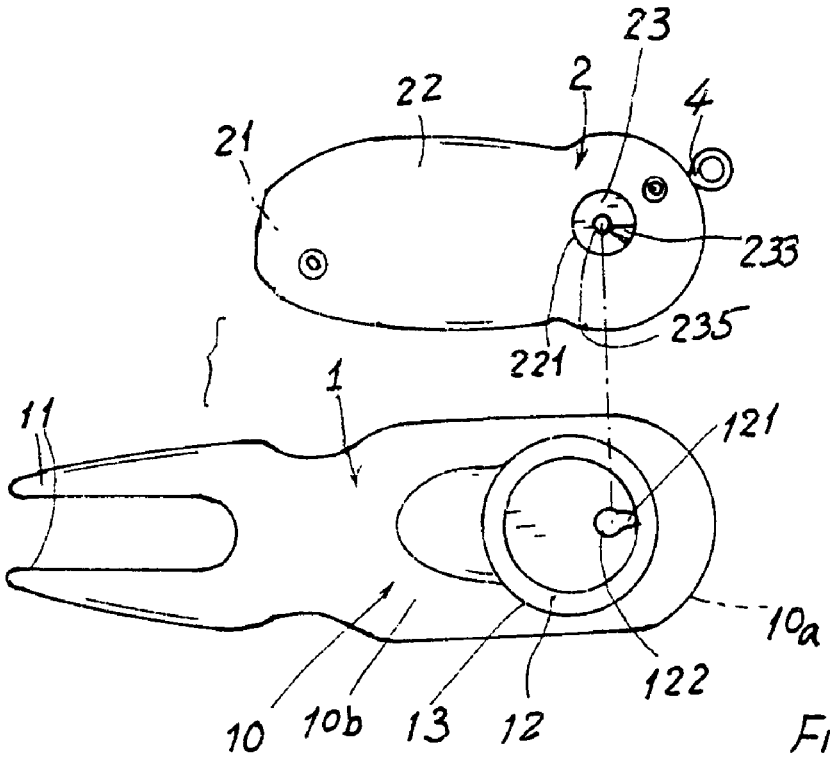
FIG. 9 shows the divot member separated from the pen member of the present invention.
Figure 10:
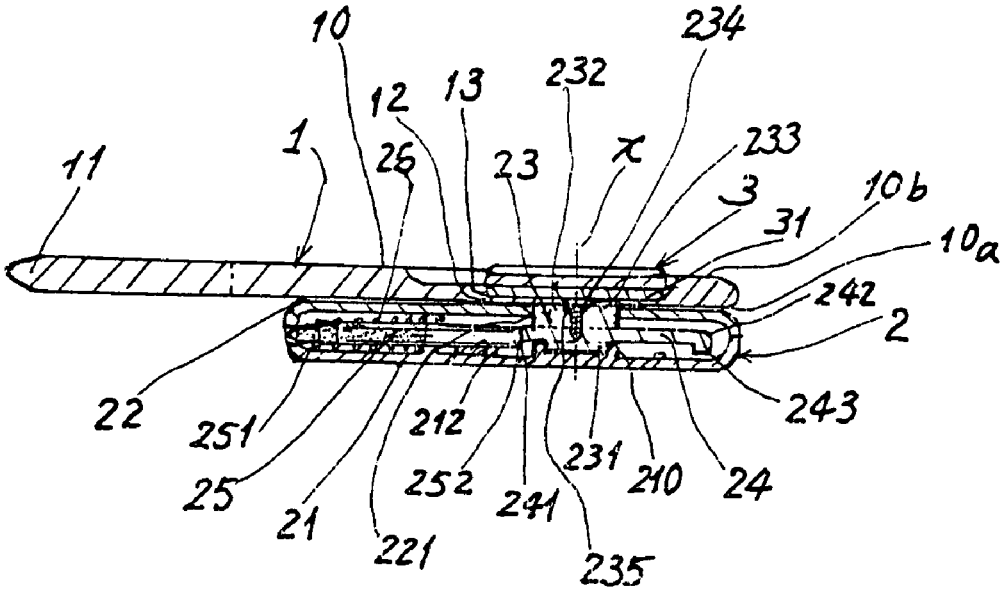
FIG. 10 is a sectional drawing of the present invention.

The shaft 23 has a first shaft portion 231 protruding distally from the cam 24 and rotatably engaged with a bushing 210 formed in the base 21, and a second shaft portion 232 protruding from the cam 24, opposite to the first shaft portion 231, towards a first surface portion 10*a* of the divot member 1 and rotatably engaged with a shaft hole 221 formed in the cover 22, a protrusion 233 protruding from the second shaft portion 232 to be engaged with a slot 122 cut out through a bottom plate 12 of the main body 10 of the divot member 1, a screw 234 inserted through a screw opening 122 formed through the bottom plate 12 of the divot member 1 and fixed into a screw hole 235 recessed in the first shaft portion 231 for securing the shaft 23 to the divot member 1, especially as shown in FIGS. 9 and 10, adapted for rotatably coupling the pen member 2 on the divot member 1.

The cam 24 has a short radius 241 about a center or axis X of the shaft 23 and normally retaining an inner end 252 of the pen 25 when resiliently restored in the housing 20 (FIG. 5); and a long radius 242, opposite to the short radius 241, gradually increasing a radius from the short radium along a cam periphery of the cam 24, and operatively thrusting the inner end 252 of the pen 25 outwardly to extendible protrude the pen 25 outwardly for writing when rotating ("R" in FIG. 6) the housing 20 of the pen member 2 about the axis X of the shaft 23 in 180 degrees from a pen-retracted position of the pen member 2.

The cam 24 includes a cam stopper 243 at the long radius 242 for stably limiting a first stopper 212 formed on the base 21 of the housing 20 adjacent to the short radius 241 of the cam 24 when rotating the pen member 2 for protruding the pen 25 outwardly.

The base 21 of the housing 20 has a second stopper 213 formed on the base 21 adjacent to the long radius 242 of the cam and opposite to the first stopper 212, whereby upon a counter-rotation ("R1" in FIG. 5) of the pen member 2 for retracting the pen 25 into the housing 20 (from FIG. 6 to FIG. 5), the second stopper 213 will be stably limited by a cam edge 242, which is angularly separated from the short radius 241 of the cam 24 in about 180 degrees.

The pen 25 may be a ball pen, a pencil lead, or the like, adapted for writing golfing scores.

Figure 1:
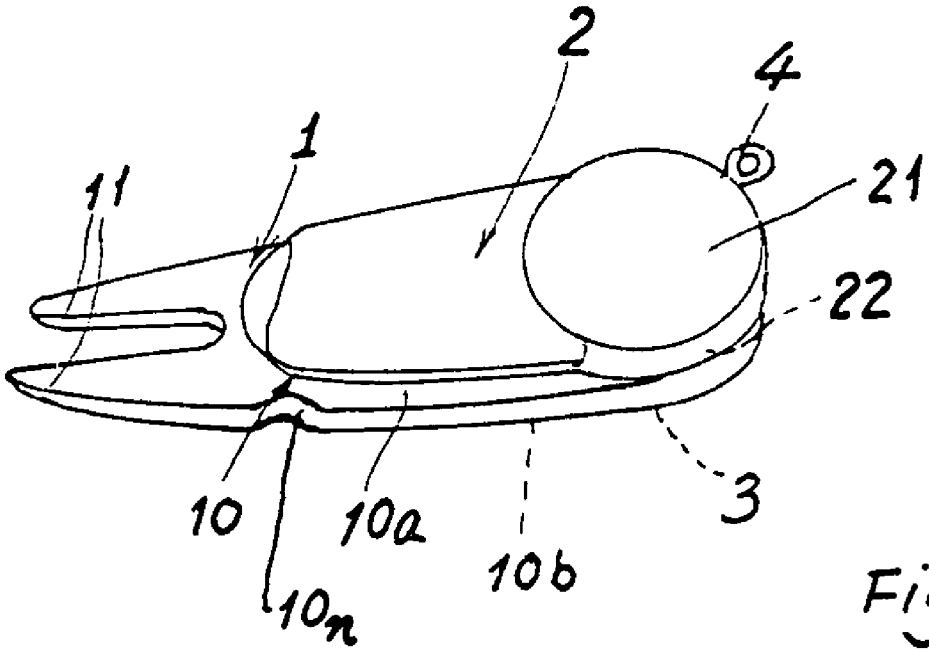
FIG. 1 shows the divot tool of the present invention provided for repairing golfing surface.
Figure 3:
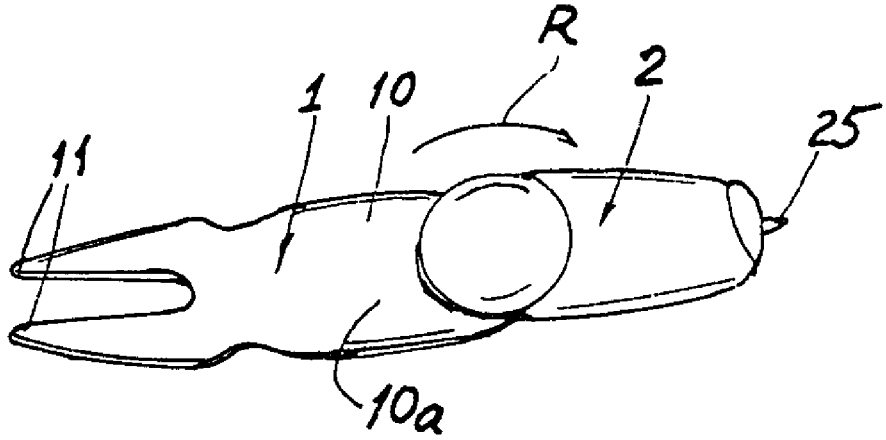
FIG. 3 shows the divot tool having the pen member extended for writing purpose.

The pen 25 is movably held in a pen guide 211 in the base 21 and has an outer pen end 251 retained on an outer spring end of the tension spring 26, and an inner pen end 252 resiliently rested on a cam periphery of the cam 24 as inwardly pulled by the tension spring 26 having an inner spring end retained in the pen guide 211; whereby upon an outward rotation of the housing 20 of the pen member 2 about the axis X of shaft 23, the inner pen end 252 will be thrusted outwardly from the short radius 241 towards the long radius 242 of the cam 24 against the tension spring 26 to protrude the pen 25 outwardly for writing as shown from FIG. 5 (or FIG. 1) to FIG. 6 (or FIG. 3).

The marker 3 is made of ferrous material and magnetically attracted to a magnet 31 which is secured in a recess 13 as recessed in the second surface portion 10*b* of the main body 10 towards the bottom plate 12 (FIGS. 7, 8 and 10), whereby upon removal of the marker 3 from the magnet 31, the marker 3 will serve for marking purpose on a green.

The divot tool of the present invention further includes a hanger 4 integrally formed on the divot member 1 or pen member 2 and detachably fastened to a golf bag B by a fastening device 41, such as a hook device (or a chain device) as shown in FIG. 11.

Figure 4:
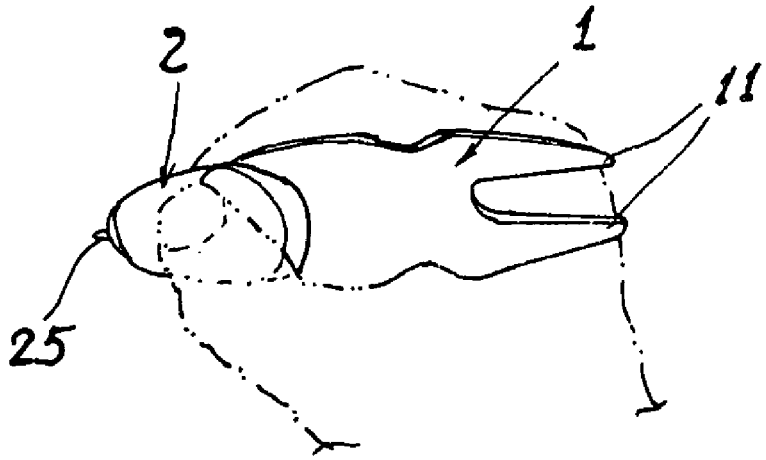
FIG. 4 shows the divot tool when held by the user for writing.

The present invention is superior to the prior art with following advantages:

1. The pen 25 may be quickly extended just by rotating the pen member 2 on the divot member 1 for a convenient writing.
2. The pen member 2 is rotatably secured to the divot member 1, thereby preventing from being lost.
3. The divot member 1 and the housing 20 of the pen member 2, when linearly extended as shown in FIGS. 3 and 4, may well serve as a pen holder (or handle) of the pen 25 for easily ergonomic writing purpose.

The present invention may be further modified without departing from the spirit and scope of the present invention.

I claim:

1. A divot tool comprising:

a divot member;

a pen member having a pen resiliently held therein, said pen member rotatably mounted on said divot member and having said pen normally retracted in said pen member to be rested on said divot member; and a marker magnetically attracted on the divot member; and whereby upon rotation of said pen member about said divot member, said pen of said pen member is protruded for writing.

2. A divot tool according to claim 1, wherein said divot member has a pair of legs bifurcated from a main body of the divot member for repairing a golfing surface; and said main body of the divot member having a first surface portion thereof provided for rotatably mounting the pen member thereon, and having a second surface portion, opposite to the first surface portion, of the main body for magnetically attracting the marker on said second surface portion.

3. A divot tool according to claim 1, wherein said divot member further includes a hanger detachably fastened to a golf bag.

4. A divot tool according to claim 1, wherein said pen member further includes a hanger detachably fastened to a golf bag.

5. A divot tool according to claim 2, wherein said pen member includes: a housing formed by combining a base and a cover, a shaft secured to the main body of the divot member and defining an axis X at a shaft center for rotatably coupling the housing on the main body of the divot member, a cam integrally formed on the shaft, and a pen resiliently held in the housing and normally restored and retracted in the housing by a tension spring retained in the housing, with the pen operatively thrusted by a cam periphery of said cam to be protruded outwardly from the housing for writing.

6. A divot tool according to claim 5, wherein said shaft has a first shaft portion protruding distally from the cam and rotatably engaged with a bushing formed in the base, and a second shaft portion protruding from the cam, opposite to the first shaft portion, towards a first surface portion of the divot member and rotatably engaged with a shaft hole formed in the cover, a protrusion protruding from the second shaft portion to be engaged with a slot cut out through a bottom plate of the main body of the divot member, a screw inserted through a screw opening formed through the bottom plate of the divot member and fixed into a screw hole recessed in the first shaft portion for securing the shaft to the divot member, adapted for rotatably coupling the pen member on the divot member.

7. A divot tool according to claim 5, wherein said cam has a short radius about the axis of the shaft and normally retaining an inner end of the pen when resiliently restored and retracted in the housing; and a long radius, opposite to the short radius, gradually increasing a radius from the short radius along a cam periphery of the cam, and operatively outwardly thrusting an inner end of the pen as urged on the cam periphery to extendiby protrude the pen outwardly for writing when rotating the housing of the pen member about the axis of the shaft in 180 degrees from a pen-retracted position of the pen member.

8. A divot tool according to claim 7, wherein said cam further includes a cam stopper at the long radius for stably limiting a first stopper formed on a base of the housing adjacent to the short radius of the cam when rotating the pen member for protruding the pen outwardly.

9. A divot tool according to claim 8, wherein said base of the housing has a second stopper formed on the base adjacent to the long radius of the cam and opposite to the first stopper of the base, whereby upon a rotation of the pen member for retracting the pen into the housing, the second stopper will be stably limited by a cam edge of the cam, said cam edge being angularly separated from the short radius of the cam in 180 degrees.

10. A divot tool according to claim 5, wherein said pen is movably held in a pen guide in the base and has an outer pen end retained on an outer spring end of the tension spring, and an inner pen end resiliently rested on a cam periphery of the cam as inwardly pulled by the tension spring having an inner spring end retained in the pen guide; whereby upon an outward rotation of the housing of the pen member about the axis of shaft, the inner pen end will be thrusted outwardly from a short radius towards a long radius of the cam against the tension spring to protrude the pen outwardly for writing.

11. A divot tool according to claim 1, wherein said marker is made of ferrous material and magnetically attracted to a magnet which is secured in a recess as recessed in a main body of the divot member, whereby upon removal of the marker from the magnet, the marker will serve for marking purpose on a green.

12. A divot tool according to claim 1, wherein said divot member has a neck portion recessed therein, adapted to be grasped by a golfer's finger or to be clipped by a pair of clips formed on a divot holder securable to a golf bag.

* * * * *